US005992110A

United States Patent [19]

Clear

[11] Patent Number: 5,992,110

[45] Date of Patent: Nov. 30, 1999

[54] WALL PANELS AND JOINT STRUCTURES

[76] Inventor: Theodore E. Clear, 429 S. Washington Blvd., Hamilton, Ohio 45013

[21] Appl. No.: 08/518,196

[22] Filed: Sep. 7, 1995

[51] Int. Cl.[6] ..... E04B 1/80; E04B 2/08

[52] U.S. Cl. ..... 52/271; 52/284; 52/293.3; 52/309.9; 52/309.14; 52/509; 52/586.2; 52/713

[58] Field of Search ..... 52/586.1, 586.2, 52/309.9, 309.14, 272, 293.3, 509, 713, 715, 265, 271

[56] References Cited

U.S. PATENT DOCUMENTS

| | | | |
|---|---|---|---|
| 2,858,584 | 11/1958 | Gaines | 52/509 |
| 2,953,873 | 9/1960 | Tatro | 52/293.3 |
| 3,196,499 | 7/1965 | Houvener | 52/272 |
| 3,276,797 | 10/1966 | Humes, Jr. | 52/715 |
| 3,350,830 | 11/1967 | Smith, Jr. et al. | 52/509 |
| 3,512,819 | 5/1970 | Morgan et al. | 52/586.1 |
| 3,960,460 | 6/1976 | Fischer . | |
| 4,052,831 | 10/1977 | Roberts et al. | 52/509 |
| 4,443,988 | 4/1984 | Coutu, Sr. | 52/586.1 |
| 5,216,854 | 6/1993 | Emmert | 52/586.1 |

FOREIGN PATENT DOCUMENTS

| | | | |
|---|---|---|---|
| 2166396 | 5/1979 | Germany | 52/309.9 |

*Primary Examiner*—Michael Safavi

[57] ABSTRACT

A wall panel and joint structure for erecting structurally sound, thermally efficient and inexpensive structures for human habitat. Each wall panel includes a foam core faced on each side with reinforced cementitious facing panels, the foam edges of the composite panel being grooved peripherally inside the cementitious facing panels. At least one metal tongue member is inserted in opposing side edge grooves of abutting wall panels, and fasteners are mounted through the cementitious facing panels, any intervening foam, and into the tongue members to hold adjacent wall panels together. U-shaped channels are provided to finish an upper edge of the wall panel and to secure a bottom edge thereof to a floor structure. Wall mount clips are provided to secure the wall panels to existing subwall structures. Flanges are provided at an upper end of the tongue members to secure roofing members to the wall panels.

12 Claims, 3 Drawing Sheets

WALL PANELS AND JOINT STRUCTURES

FIELD OF THE INVENTION

This invention relates to wall panels and more particularly to insulated wall panels, apparatus for interconnecting such panels together to form walls, and to apparatus for connecting the panels to associated structures such as floors, roofs and sub-walls.

BACKGROUND OF THE INVENTION

It has long been desirable to provide a single, thermally efficient, inexpensive wall panel structure for use in erecting housing or other structures. While many attempts have been proposed, many such wall panel structures are not sufficiently strong to serve as structural building panels without extraneous support or internal studding and the like. Such studding adds components and costs and frequently presents a thermal "short circuit" or bridge lowering the insulative value or rating of the panel.

Moreover, when individual panels are interconnected or joined, they may "rack", slide or twist with respect to each other resulting in less than desirable structural stability.

In addition, it is highly desirable to provide a thermally insulative weather-resistant wall panel capable of joinder with other such panels to produce a structurally sound and durable wall structure useful in erecting and forming the walls of a house or building. In many areas of the world, in relative low income, high population areas, inexpensive, structurally sound housing is difficult to obtain. The provision of insulated panels suitable for joinder to form structurally sound, thermally efficient, inexpensive enclosures for human habitat is particularly desirable.

While insulated wall panels have been proposed, the joining of the panels together, as well as the mounting of panels to associated other structures, are subjects in need of new ideas and improvements. As noted, prior joint and joinder concepts appear to lack a sufficiently substantive nature, produce a thermal "short circuit" destroying the panel's "R" value, or both. Moreover, it has been found difficult to provide a foam core wall panel of sufficient joinder strength and rigidity to serve as a component of a structural wall of such panels.

Accordingly, it has been one objective of this invention to provide an improved wall panel and apparatus for joining similar panels to form a structural capacity wall.

Another objective of the invention has been to provide an improved apparatus for securing one or more panels to a floor.

Another objective of the invention has been to provide an improved apparatus for securing one or more panels to a roof.

Another objective of the invention has been to provide an improved wall panel and mounting system without thermal transfers through the panel due to wall mounting or panel-joining components, wall studs or the like.

It will be appreciated that in some cultures or environments, there are pre-existing structures or walls, frequently old, which form the boundary of an office or apartment. These are occasionally damp and non-uniform. For example, in certain high-population density areas around the world, large multiple tenant structures have tapered, waving or damp interior structural walls unfit to serve as a basis for a healthy home.

Accordingly, a further objective of the invention is to provide a functional wall which may easily be adapted to and mounted on existing sub-walls despite irregularities of plane, wet or leaking conditions or the like.

SUMMARY OF THE INVENTION

To these ends, a preferred embodiment of the invention includes a composite, foam core panel faced on each side with a reinforced cementitious panel, the foam edges of the composite panel being grooved peripherally inside the cementitious facing panel. Preferably, two parallel grooves are erected in each foam edge. To join composite panels edgewise, at least one flat metal strip is inserted in the groove of one panel edge and the opposed groove of an adjacent panel edge, forming a tongue enveloped by edges of both adjacent panels. Screws or other suitable fasteners are mounted through the cementitious panels, any intervening foam, and into the tongue, which thereby holds the two adjacent panels together. The tongue itself is barbed or has sharply folded edges serving as returns to dig into the foam edges of the grooves to prevent the tongue from moving after it has been inserted, thereby facilitating assembly.

Preferably, a tongue is disposed vertically extending in each adjacent groove of respective abutting panels; thus two tongues are inserted in each abutting panel edge or face.

When installing panels on a floor, a U-shaped channel with upstanding legs is secured to the floor, and the panels are lowered over the channels, the legs of the channel extending upwardly into two parallel grooves in the foam face or edge of the panel.

The top edge of the composite panel may be finished off with a downwardly disposed U-shaped channel over and extending along the top edge of the panel.

In any case, the screws into the panel joining tongue, at its ends, may also extend through the floor mounted channel and any panel cap, respectively, to provide extra rigidity to the panel wall system so created.

Where one panel is placed atop another, horizontal joining tongues disposed in the horizontal adjacent grooves are used to provide a wall of multiple panel height.

The result of such composite structures is quite spectacular; the panels so joined provide a load bearing wall, for example, not subject to "racking", i.e. where each of the panels might be twisted or racked, as a house, for example, made of such panels is blown by the wind.

Moreover, it will be appreciated that there is no through studding in the panel walls or joints between the panels. Thus, the foam constitutes a continuous barrier against the conduct of heat through the panels and is not compromised by any through structure, such as fastener-studding brackets or the like. Accordingly, a 3-inch thick foam panel with cementitious reinforced panel facings provides a wall of insulative value of about R18, whereas a common 2×4 studded wall with foam or batting may be a maximum rating of R14.

It will be appreciated that the elongated ties, and the clips which are hereinafter described, rely on the strength of the foam within the panels and do not compromise the R value of the panel.

In one alternative form, the tie or tongue members may be provided with bent over flanges at their upper ends and the upper C-shaped channel eliminated. These upper flanges could be screwed into the bottom of a roofing panel or structure to join the vertical wall panels to a roofing structure.

In another embodiment, the invention contemplates securing such panels to an existing wall or sub-wall structure. For example, a composite foam panel may have either both sides of foam faced with a reinforced cementitious panel or only one side faced with such a panel. In any event, a groove is cut into the foam edge around the periphery of the panel, and a Z-shaped clip is placed, for example, with one leg inserted into the groove and the other leg extending rearwardly for interconnection to a wall. That leg is turned flush with the wall and secured thereto, or could be shimmed outwardly from the wall, so as to provide a planar panel wall with the shims accommodating any variation in the existing wall or sub-wall. In addition, the same Z-shaped clip could be utilized at the top edge of the panel for securing the top edge of the panel to a roofing or other support structure.

In an alternative of this embodiment, an L-shaped clip is utilized, with the short leg extending into the groove in the panel and the long leg extending rearwardly. That long leg is connected to a complimentary L-shaped clip secured to an existing wall, back-wall, or other support, for example, with the inter-engagement between the two L-shaped clips being adjustable or decided by the application of a self-threading screw, for example, and with enough play between the longer leg of the panel clip and the shorter or longer leg of the L-shaped clip on the backer wall to provide sufficient adjustment to accommodate any non-planar variations in the existing wall or sub-wall. This wall mounting is thus accomplished without any compromise in the thermal insulative properties of the panel so that there are no thermal shorts in the system.

Accordingly, the inventor provides an insulated, structural panel suitable for use in erecting structurally sound, weather-resistant walls for enclosures such as housing and building. At the same time, the invention provides an insulated panel suitable for attachment to an existing wall or sub-wall despite irregularities, wetness and the like which otherwise may not be suitably faced.

BRIEF DESCRIPTION OF THE DRAWINGS

These and other objectives and advantages will become readily apparent from the following written description of a preferred embodiment of the invention, and from the drawings, in which.

DETAILED DESCRIPTION OF THE INVENTION

Figure 1:
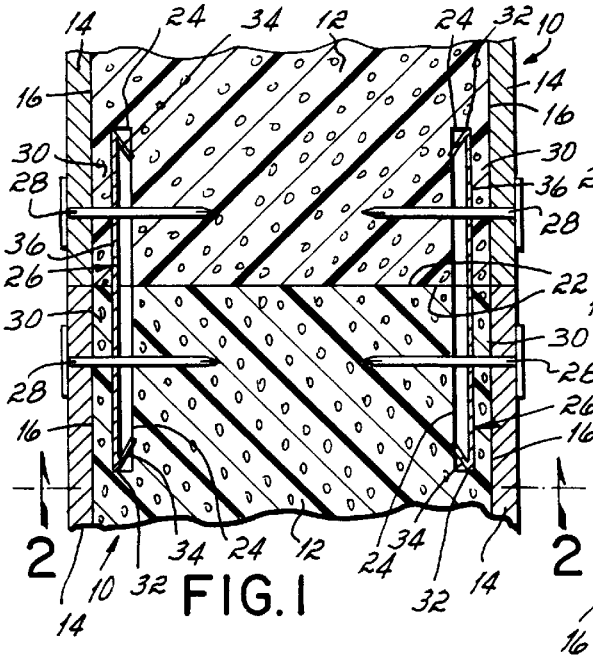
FIG. 1 is a cross-sectional plan view of two panels joined by two tongues or ties and screws or fasteners according to the invention.
Figure 3:
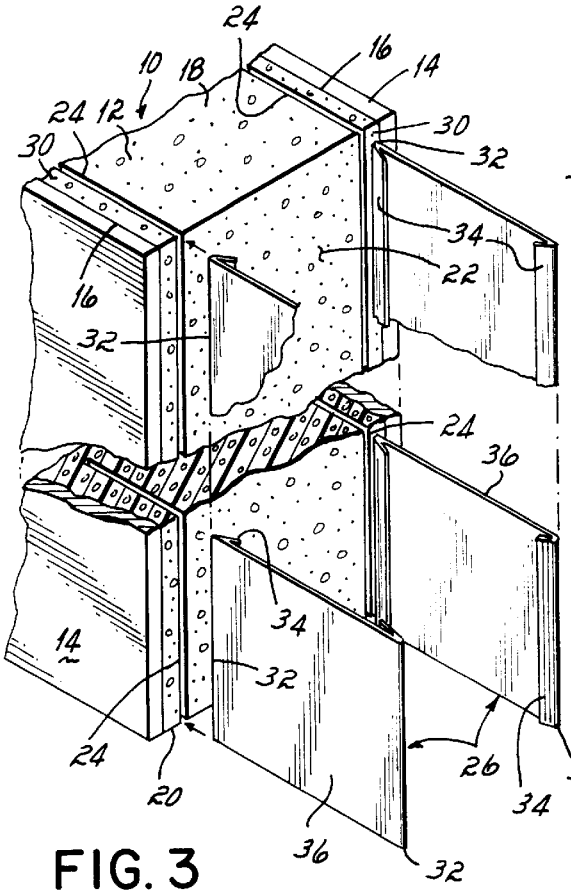
FIG. 3 is an exploded view of one panel edge and two associated panel tongues.
Figure 4:
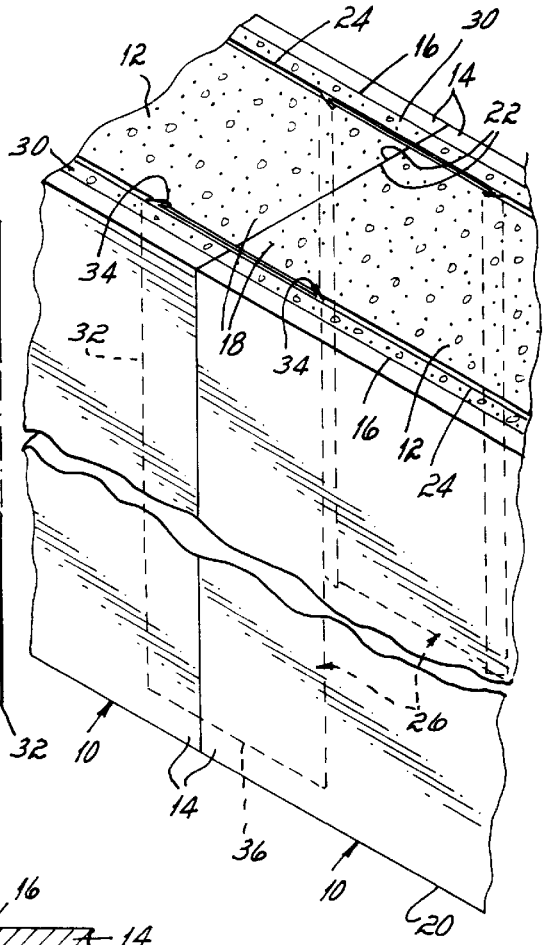
FIG. 4 is an isometric cut-away view of two panels joined by two tongues.

Referring now to the drawings in detail, a pair of abutting composite wall panels 10 are shown joined in accordance with one embodiment of the present invention in FIGS. 1 and 4. Each wall panel 10 includes a foam core 12 having reinforced cementitious facing panels 14 adhesively bonded to opposite side faces 16 of the foam core. The foam core 12, preferably 3" thick, includes a top edge 18, a bottom edge 20 and a pair of parallel side edges 22, with each peripheral edge preferably including a pair of elongated and parallel grooves 24 (see FIG. 3) extending into the edges 18, 20 and 22 (and the far edge, not shown) approximately 1-½" as will be described in more detail below. In a preferred embodiment, a pair of elongated tongues or tie members 26 are inserted vertically in opposing side edge grooves 24 of abutting wall panels 10 to join the wall panels in accordance with the present invention as will be disclosed in more detail below.

As shown most clearly in FIG. 3, each wall panel 10 preferably includes the parallel grooves 24 extending into the edges 18, 20 and 22 approximately ½" to 1" from the opposite side faces 16 of the foam core 12 adjacent the cementitious facing panels 14. The construction and manufacture of the reinforced cementitious facing panels 14, sold under the trademark "UTIL-A-CRETE", are described in detail in U.S. Pat. Nos. 4,203,788; 4,428,952; 4,420,295; RE32,037; RE32,038 and RE31,921, all of which are herewith incorporated herein by reference.

As shown in FIGS. 1 and 4, the pair of tongue members 26 are inserted vertically into opposing side edge grooves 24 of abutting wall panels 10, and the wall panels are further secured by fasteners 28 (see FIG. 1) extending through the cementitious facing panels 14, intervening foam portions 30, and into the tongue members to hold the abutting wall panels together. Each tongue member 26 includes lateral edges 32 defined by sharply folded edges or returns 34 extending inwardly and rearwardly from a front face 36 of the tongue member. It will be appreciated that as the tongue members 26 are inserted into the grooves 24, the returns 34 dig into the foam core 12 adjacent the grooves to prevent the tongue members from moving after they have been inserted between abutting wall panels 10. In this way, the tongue members 26 are enveloped by the side edges 22 of abutting wall panels 10, and the fasteners 28, such as screws or the like, are inserted through the reinforced cementitious facing panels 14 on each side face 16 as described above to join the wall panels in accordance with the invention. It will be appreciated that wall panels 10 could likewise be joined one atop another, with the tongue members 26 inserted horizontally into respective opposing top and bottom edge grooves 24 of abutting wall panels to provide a wall of multiple panel height.

Figure 2A:
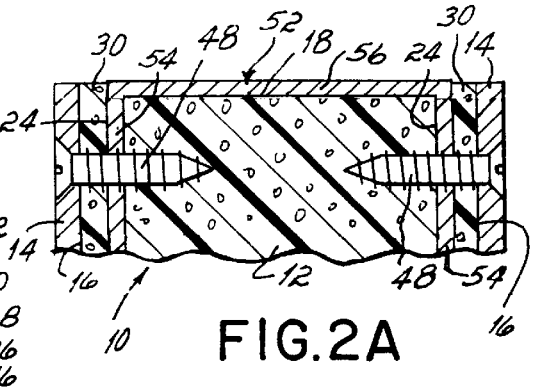
FIG. 2A is a cross-sectional view of one panel having a panel cap at an upper end.
Figure 2:
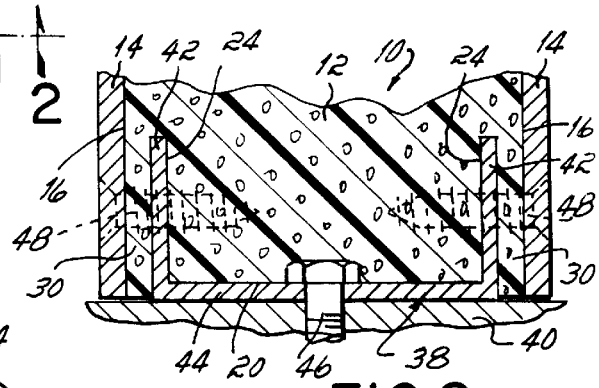
FIG. 2 is cross-sectional view of one panel showing panel joinder to a floor at a lower end.

Referring to FIG. 2, a U-shaped footer channel 38 is shown for mounting the wall panels 10 to a floor 40. In one embodiment, each footer channel 38 includes a pair of upstanding legs or flanges 42 joined through a web 44 normal to each of the flanges. A bolt 46 or other suitable fastener is inserted through the web 44 and into the floor 40 to secure the footer channel 38 to the floor. At least one wall panel 10 is lowered onto the footer channel 38, with the upstanding flanges 42 extending into respective parallel grooves 24 formed in the bottom edge 20 of the wall panel.

Figure 2B:
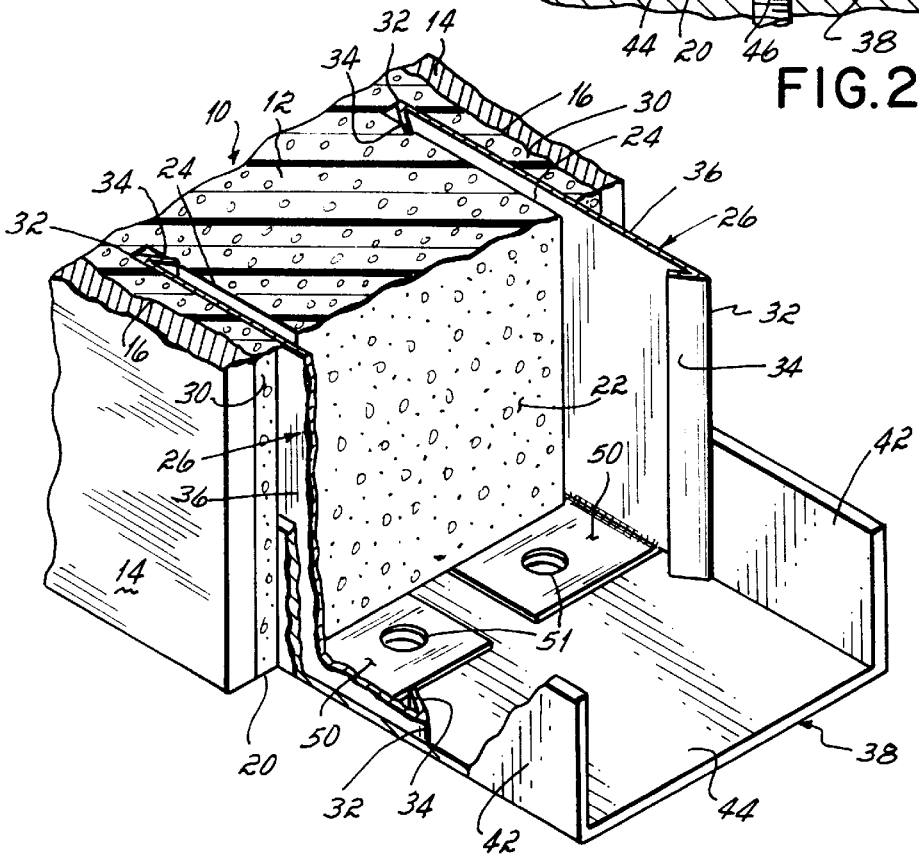
FIG. 2B is an isometric illustration showing one alternative tongue and channel connection at a panel bottom.

Fasteners 48 are preferably inserted through the cementitious facing panels 14, the tongue members 26 (not shown), and into the flanges 42 to secure the wall panel 10 to the footer channel 38. In an alternative embodiment shown in FIG. 2B, each tongue member 26 includes a tab 50 extending along the web 44, with each tab being secured to the web through a bolt (not shown) or other suitable means extending into the floor (not shown) through apertures 51.

Referring to FIG. 2A, a U-shaped cap panel 52 is provided in one embodiment to finish the top edge 18 of the wall panel 10. The cap panel 52 includes a pair of depending legs or flanges 54 joined through a web 56 normal to each of the flanges. The cap panel 52 is inserted on the top edge 18 of the wall panel 10, with the depending flanges 54 extending into respective grooves 24 formed in the top edge. Fasteners 48 are preferably inserted through the cementitious facing panels 14, the tongue members (not shown), and into the flanges 54 to secure the cap panel 52 to the wall panel 10.

Figure 5:
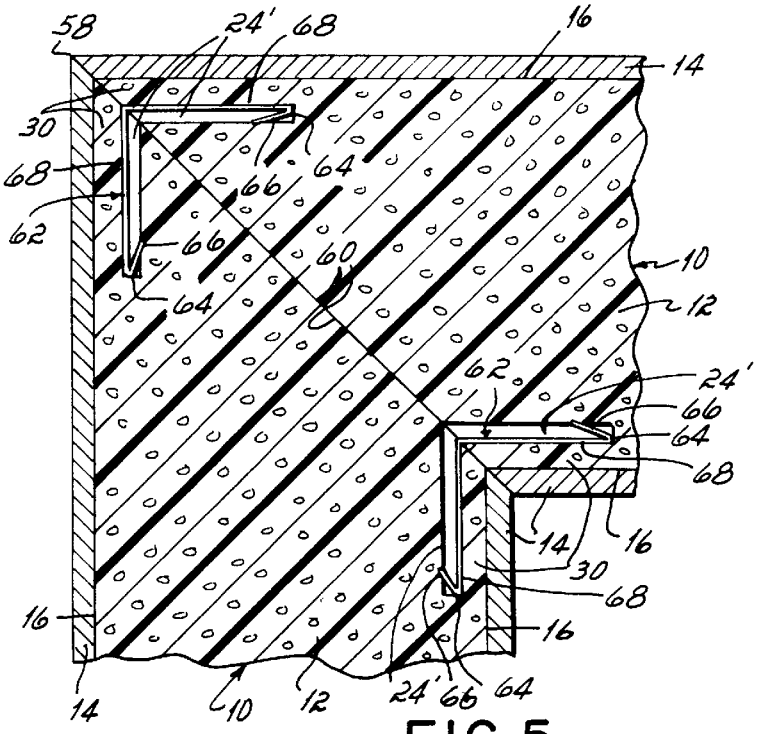
FIG. 5 is a plan view showing the joinder of two panels at a 90° corner.

Referring to FIG. 5, a pair of abutting wall panels 10 are shown joined at a corner 58. Each wall panel 10 includes an inclined edge 60 abutting the inclined edge of the other wall panel and further includes a pair of parallel grooves 24' extending into each inclined edge. The abutting inclined edges 60 are joined at the corner 58 through a pair of angled tongue members 62 inserted into the respective aligned grooves 24' of the abutting wall panels 10. It will be appreciated that the tongue members 62 include a longitudinal bend or angle at approximately the same angle as the corner 58. As with the tongue members 24 described above, the angled tongue members 62 have lateral edges 64 defined by sharply folded edges or returns 66 extending inwardly and rearwardly from front faces 68 of the angled tongue members. Fasteners (not shown) extend through the cementitious facing panels 14, intervening foam portions 30, and into the angled tongue members 62 to hold the abutting wall panels 10 together at the corner 58.

Figure 6:
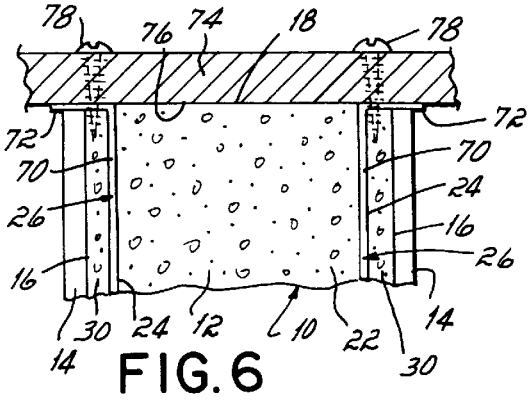
FIGS. 6 and 7 are cross-sectional views similar to FIG. 2 but showing the tongues having roof-attaching flanges.
Figure 7:
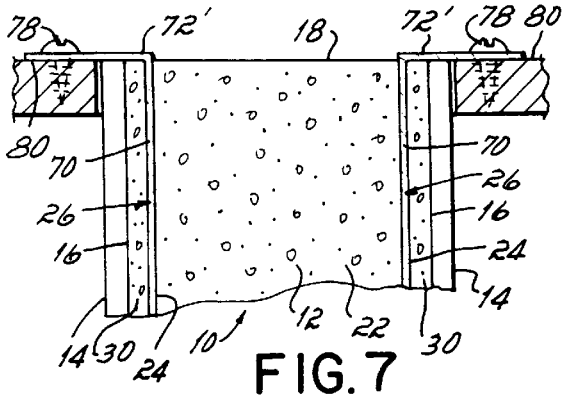

In a preferred embodiment as shown in FIGS. 6 and 7, each tongue member 26 includes an upper end 70 having a tab 72 bent parallel to the top edge 18 and extending outwardly toward the cementitious facing panel 14 for securing the tongue member 26 and associated wall panel 10 to a roof member 74. In one embodiment shown in FIG. 6, each tab 72 of respective tongue members 26 is secured to a lower surface 76 of the roof member 74 through fasteners 78. In another embodiment shown in FIG. 7, tabs 72' extend outwardly away from the wall panel 10 and are secured to an upper surface 80 of the roof member 74 through fasteners 78.

Figure 8:
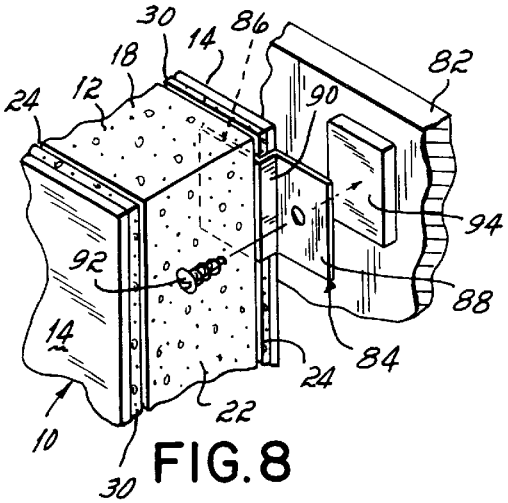
FIG. 8 is a view of a double-faced panel and Z-shaped wall-mount clip with optional shim according to the invention.

Referring now to FIG. 8, a wall panel 10 is shown being joined to a subwall or back-wall 82 in accordance with one embodiment of the present invention. A "Z-shaped" integral wall mount clip or bracket 84 is provided having a pair of legs 86 and 88 lying in two parallel, spread-apart planes and joined by an integral web 90 normal to each of the legs. The leg 86 is inserted into one of the parallel grooves 24 nearest the subwall 82 and the rearwardly extending leg 88 is joined either directly to the subwall by a fastener 92 or indirectly to the wall through an optional shim 94. It will be appreciated that the shim 94 can be provided to accommodate for non-planar irregularities in the existing subwall 82 but is not required as part of the present invention. It is understood that the leg 86 inserted into the groove 24 could include a sharply folded edge or return (not shown) to dig into the foam core adjacent the groove as described above with reference to the tongue members 26. While not shown, the bracket 84 is secured to the wall panel 10 through a suitable fastener extending through the cementitious facing panel 14, intervening foam portion 30, and into the leg 86 to hold the wall panel to the subwall 82.

Figure 9:
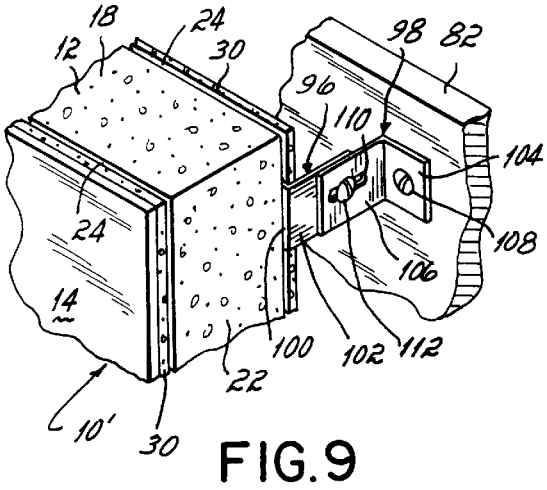
FIG. 9 is a view similar to FIG. 8 but showing a single-faced panel and two L-shaped wall mount clips according to an alternative embodiment of the invention.

In another embodiment shown in FIG. 9, a wall panel 10' is shown secured to a subwall or back-wall 82 through a pair of cooperating "L-shaped" wall mount clips or brackets 96 and 98. In this embodiment, the wall panel 10' includes a cementitious facing panel 14 secured to one of the side faces 16 of the foam core 12, with the other side face of the foam core lying adjacent the subwall 82. Wall mount clip 96 includes a pair of legs 100 and 102 normal to each other. Leg 100 is inserted into one of the parallel grooves 24 adjacent the side face 16 nearest the subwall 82, and the rearwardly extending leg 102 is joined to the complimentary "L-shaped" wall mount clip or bracket 98 secured to the existing subwall or back-wall 82. Alternatively, leg 100 is inserted into the panel groove nearest facing 14 and leg 102 extended to meet bracket 98. The complimentary bracket 98 secured to the wall 82 includes a pair of legs 104 and 106 normal to each other, with the leg 104 being joined to the wall 82 through a fastener 108 or other suitable means. Each leg 102 and 106 includes an elongated aperture 110, and a self-threading screw 112 is inserted through the apertures 110 of the legs to provide adjustable inter-engagement between the leg 102 and 106 of the wall mount clips 96 and 98. In this way, adjustment is provided for securing the wall panel 10' to a subwall 82 having non-planar irregularities. It is understood that the leg 100 inserted into the groove 24 could include a sharply folded edge or return (not shown) to dig into the foam core adjacent the groove as described above with reference to the tongue members 26. While not shown, the bracket 96 is secured to the wall panel 10' through a suitable fastener extending through the foam portion 30 and into the leg 100 to hold the wall panel to the subwall 82.

Figure 10:
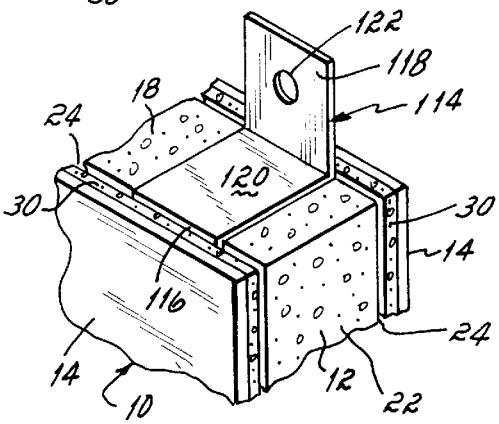
FIG. 10 is a view similar to FIG. 3, but showing an alternative roof-mount clip.

As shown in FIG. 10, an integral "Z-shaped" roof mount clip or bracket 114 is provided for securing the wall panel 10 to a roof member (not shown). The roof mount clip 114 includes a pair of legs 116 and 118 lying in two parallel, spread-apart planes and joined by an integral web 120 normal to each of the legs. The leg 116 is inserted into one of the parallel grooves 24 with the web 120 extending parallel to the top edge 18 of the wall panel 10. The upwardly extending leg 118 includes an aperture 122 for receiving a fastener (not shown) extending into a roof member secured on the top edge of the wall panel.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of applicant's invention.

What is claimed is:

1. The combination of at least two adjacent panels defining a wall structure, the combination including:

each of said panels having a foam core having at least two side faces and peripheral edges;

a cementitious facing at least one of said side faces of each panel;

two separate parallel grooves extending into at least each of two parallel edges of said foam core for receiving panel connecting tongues therein;

said grooves being formed in said core such that each groove in each edge is open at said edge and has two opposed faces formed by said foam core and a blind end in said foam core, and wherein each groove is spaced from its nearest facing at least about ½ inch;

one interconnecting elongated tongue disposed in cooperating and aligned grooves of each of said adjacent panels, said respective cooperating grooves being aligned and in register with each other for receiving said tongue for coupling said panels together, such that two tongues are aligned respectively in the two separate parallel grooves in each panel edge adjoining another panel edge; and further including a U-shaped footer channel disposed horizontally beneath a panel and having two flanges extending upwardly into respective grooves disposed on a bottom edge of at least one panel and in which grooves said respective tongues are disposed.

2. A combination as in claim 1 further including fasteners extending through said cementitious facing of said panel, into said channel flanges and into said tongues for holding said panel, channel and tongues together.

3. A combination as in claim 2 wherein said tongues include a tab extending therefrom along a web of said channel, said tab being secured to said web.

4. The combination of at least two adjacent panels defining a wall structure, the combination including:

each of said panels having a foam core having at least two side faces and peripheral edges;

a cementitious facing at least one of said side faces of each panel;

two separate parallel grooves extending into at least each of two parallel edges of said foam core for receiving panel connecting tongues therein;

said grooves being formed in said core such that each groove in each edge is open at said edge and has two opposed faces formed by said foam core and a blind end in said foam core, and wherein each groove is spaced from its nearest facing at least about ½ inch;

one interconnecting elongated tongue disposed in cooperating and aligned grooves of each of said adjacent panels, said respective cooperating grooves being aligned and in register with each other for receiving said tongue for coupling said panels together, such that two tongues are aligned respectively in the two separate parallel grooves in each panel edge adjoining another panel edge; and further including a U-shaped cap channel having a web and two flanges, said two flanges depending alongside cementitious facings on each side of said panel and fasteners extending through said facings, into said flanges and into said tongue to hold said channel on said panel.

5. The combination of at least two adjacent panels defining a wall structure, the combination including:

each of said panels having a foam core having at least two side faces and peripheral edges;

a cementitious facing at least one of said side faces of each panel;

two separate parallel grooves extending into at least each of two parallel edges of said foam core for receiving panel connecting tongues therein;

said grooves being formed in said core such that each groove in each edge is open at said edge and has two opposed faces formed by said foam core and a blind end in said foam core, and wherein each groove is spaced from its nearest facing at least about ½ inch;

one interconnecting elongated tongue disposed in cooperating and aligned grooves of each of said adjacent panels, said respective cooperating grooves being aligned and in register with each other for receiving said tongue for coupling said panels together, such that two tongues are aligned respectively in the two separate parallel grooves in each panel edge adjoining another panel edge; and wherein said tongues have an upper end and comprising a tab bent parallel to an upper edge of said panel for securing said tongue and associated panel to a roof member.

6. A combination as in claim 5 wherein said tab is bent forward and adjacent said cementitious facing and extends outwardly therefrom away from said panel.

7. A combination as in claim 6 wherein said tab is fastened to a lower surface of a roof member.

8. A combination as in claim 6 wherein said tab is fastened to an upper surface of a roof member.

9. A panel and bracket for mounting the panel on an existing wall or sub-wall and comprising:

a foam core having two side faces and peripheral edges;

at least one cementitious facing or core of said faces;

at least one groove in extending into said foam core from said peripheral edges, said groove having two opposed faces defined in said core and being spaced in said edge from said facings at least about ½ inch; and a bracket for mounting said panel, said bracket comprising:

a first leg for extending into said groove in said core; and a second leg extending away from said panel edge for attachment to a supporting wall; and wherein said bracket comprises a two-part adjustable bracket, one part having a first leg extending into said groove and a second leg extending perpendicularly therefrom, away from said panel, and another part having a first leg extending in the same direction as said second leg of said one part and a second leg extending perpendicularly therefrom for attachment to a support and fastener coupling said second leg of said one part to said first leg of said other part in a plurality of adjustable positions.

10. An enclosure comprising a plurality of structural panels wherein:

each panel comprises a foam core having two side faces and peripheral edges;

a cementitious facing on each side of each panel;

said panels being oriented in abutting edge-to-edge relationship with an adjacent panel;

said abutting edges each having at least two separate parallel grooves in said foam core extending to the edge of each panel;

said grooves being formed in said core such that each groove in each edge is open at said edge and has two opposed faces formed by said foam core and a blind end in said foam core, and wherein each groove is spaced from its nearest facing at least about ½ inch;

the grooves in said edges being aligned and in register with adjacent cooperating grooves in said respective panels;

an elongated tongue disposed in said adjacent grooves, said tongues extending between two panel edges for securing said panels structurally together; and fasteners extending through said facings and into said tongues for bolting said tongues and panels together;

further including U-shaped footer channels for said panels, said channels having at least two flanges extending upwardly respectively into grooves disposed in a lower edge of said panel; and further including fasteners securing a lower end of said tongues to said footer flanges.

11. An enclosure as in claim 10 wherein said tongues include tabs extending from the bottom thereof, said footer channel having a web and fasteners securing said tabs to said web.

12. An enclosure as in claim 10 wherein said tongues have tabs at their upper ends at angles to said tongue for securing said tongues to a roof structure.

* * * * *